United States Patent [19]

Dugan et al.

[11] 4,235,338

[45] Nov. 25, 1980

[54] UNITARY MOLDED CONTAINER LID AND TRAY FOR ARTICLE PACKAGING

[75] Inventors: David R. Dugan, Warsaw; Kenneth E. Prince, Indianapolis, both of Ind.

[73] Assignee: Owens-Illinois, Inc., Toledo, Ohio

[21] Appl. No.: 31,883

[22] Filed: Apr. 20, 1979

Related U.S. Application Data

[63] Continuation of Ser. No. 837,951, Sep. 29, 1977, abandoned.

[51] Int. Cl.[3] ..... B65D 85/20

[52] U.S. Cl. ..... 206/443; 206/528; 206/508; 206/520; 206/557; 220/4 B; 220/306

[58] Field of Search ..... 206/443, 449, 508, 509, 206/520, 519, 528, 538, 557, 561, 503, 505; 220/4 B, 4 E, 306, 22.3, 72; 229/2.5 R

[56] References Cited

U.S. PATENT DOCUMENTS

| | | | |
|---|---|---|---|
| 2,606,586 | 8/1952 | Hill | 206/578 |
| 2,811,768 | 11/1957 | Axelson | 220/306 |
| 2,893,456 | 7/1959 | Wallace | 150/0.5 |
| 2,984,382 | 5/1961 | Florsheim | 220/306 |
| 3,297,191 | 1/1967 | Eastman | 206/508 |
| 3,419,184 | 12/1968 | Asenbauer | 206/508 |
| 3,434,625 | 3/1969 | Einbery | 220/72 |
| 3,456,783 | 7/1969 | Clark | 206/443 |
| 3,565,146 | 2/1971 | Arnaldr | 150/0.5 |
| 3,696,966 | 10/1972 | Haulzer | 206/518 |
| 3,721,364 | 3/1973 | Lukaschewitz | 220/72 |
| 3,721,367 | 3/1973 | Fletcher | 206/519 |
| 3,739,939 | 6/1973 | Koenig | 206/518 |
| 3,744,663 | 7/1973 | Maren | 220/306 |
| 3,759,416 | 9/1973 | Constantine | 206/508 |
| 3,856,137 | 12/1974 | Brindley | 206/45.14 |
| 3,981,401 | 9/1976 | Blanchard | 206/508 |
| 4,061,228 | 12/1977 | Johnson | 206/523 |

*Primary Examiner*—Herbert F. Ross

*Attorney, Agent, or Firm*—John R. Nelson; Myron E. Click; David H. Wilson

[57] ABSTRACT

A container comprising a hollow tray and a domed lid, each of which are of unitary molded plastic construction. The tray has a planar bottom wall peripherally encompassed by a generally outwardly and upwardly flaring upstanding wall with a rim over which the lid is snugly attachable. Peripherally interspaced indents are molded in and offset interiorly from the upstanding wall of the tray and define interiorly facing surface regions disposed in proximately perpendicular relationship with the bottom wall of the tray.

The container is particularly suitable for packaging a plurality of small dimensionally corresponding containers, such as ampuls, or the like. As such, it provides a package accommodating a plurality of rows of containers together with an upstanding plastic separator sheet separating each row of containers. The packaged containers gravitationally rest in upstanding, snug side-by-side relationship within the tray with their axial end portions projecting above the rim of the tray and enclosed within the interior confines of the domed lid. The package is especially well-suited for decasing the containers directly onto conventional apparatus associated with commercial container-filling systems, and provides a durable, inexpensive package for packaging containers in a clean, particulate-free environment. Also, the tray and lid components are designed to accommodate internesting with other like lids and trays and to facilitate stacking of packaged containers.

35 Claims, 7 Drawing Figures

UNITARY MOLDED CONTAINER LID AND TRAY FOR ARTICLE PACKAGING

This is a continuation of application Ser. No. 837,951 filed Sept. 29, 1977, now abandoned.

BACKGROUND OF THE INVENTION

1. Field of the Invention

The present invention pertains to an ampul package as well as a molded container and constituent unitary molded lid and tray components therefor.

2. Brief Description of the Prior Art

While molded plastic containers have come into increasing use as a means of packaging sundry types of articles and goods, their applicability for packaging certain types of articles and products has not been heretofore found to be feasible. For example, in the past it has been customary practice of ampul manufacturers to package and ship open-ended, empty ampuls to a pharmaceutical house, or supplier, where the ampuls are subsequently processed, filled with an appropriate medicament, pharmaceutical, serum, or the like, and thereafter hermetically sealed. For purposes of shipment to the pharmaceutical supplier the empty ampuls conventionally have been packaged in chip board, cardboard or kraft board boxes or containers. Ordinarily, such containers comprise a hollow, rectangular box or tray over which a rectangular lid is telescopically assembled. Each shipping container ordinarily houses several rows of ampuls snugly packed in axially upstanding position. A quantity of the packed shipping containers are then grouped and stacked together to form a palletized load for shipment to the pharmaceutical house or supplier.

While the use of cardboard, chip board, or kraft board, provides a relatively economical material for packaging such ampuls for shipment, the use of any such materials has presented problems with respect to the cleanliness of the ampuls when received by the pharmaceutical supplier. During shipment, it has been found that fiber particulates tend to dislodge or become disassociated from the interior surfaces of the shipping container and accumulate or settle upon and within the interior confines of the packaged ampuls. Thus, the pharmaceutical supplier must exercise extreme and meticulous care to thoroughly cleanse such particulates from the ampul prior to the filling operation. Moreover, the presence of such particulates requires that extreme care and precaution must be taken to avoid their airborn movement or transition into the vicinity of the ampul filling areas.

One of the more commonly utilized types of apparatus for the processing of empty ampuls prior to the filling operation is the widely-known Hodes-Lange ampul washing apparatus, such as is described in U.S. Pat. No. 2,896,381. Briefly, such apparatus is designed to receive ampuls which have been packaged in separated rows of 12 each and to feed one row at a time for processing. Also, the apparatus is particularly designed to rely upon the presence of thin upright separator sheets positioned between each row of upstanding ampuls for the purpose of selectively limiting the feeding of one row of ampuls at a time to the apparatus. As constructed, the apparatus is also adapted to receive the separators and selectively separate them into suitable collection containers. In operation, the separators are required to maintain a dimensional thickness of about 0.035 inch in order to be properly handled by the apparatus. Here again, it has been customary practice to fabricate the separators from cardboard, chip board, or kraft board and their presence in the ampul shipping container and introduction into the ampul feeding apparatus constitutes a further source of contamination by fiber particulates in the vicinity of the ampul processing and filling operations.

In the past the desire to avoid the problem of contamination due to particulate fibers emanating from the shipping containers and the separators has prompted efforts to devise alternative types of ampul shipping containers or packages. For example, U.S. Pat. No. 3,266,704 describes the use of a thermoplastic liner as a dust-proof liner with which to cover the interior surfaces of a compartmented paperboard shipping carton for pharmaceutical containers. However, such efforts have failed to attain any appreciable commercial acceptance either due to the relatively high cost of such alternative forms of containers or their incompatibility with the commonly employed types of apparatus used in the pharmaceutical industry for decasing the empty ampuls from a shipping container. Accordingly, a definite need has been found to exist for a container for the shipment of empty ampuls from the ampul manufacturer to the pharmaceutical supplier which will permit the ampuls to be received by the pharmaceutical supplier in a dust-free, or particulate-free, condition. No less importantly, the need exists to structure the shipping container in such manner that it can be readily accommodated with existing ampul processing equipment and at a sufficiently low cost to warrant commercial acceptance.

SUMMARY OF THE INVENTION

In accordance with one aspect, the present invention provides a shipping container comprised of component lid and tray members which are adapted to attach snugly together to form an essentially dust-free enclosure in which to economically and protectively package various articles for shipment. Both the lid and tray components are unitary, or one-piece, molded plastic members which are preferably fabricated from a relatively thin, relatively flexible, thermoformable, or vacuum formable, sheet of plastic material such as, among others, a thin sheet of thermoformable, high-impact, polystyrene material. As thus formed, the resultant lid and tray provide relatively inexpensive container components which provide a dust-free, or particulate-free, shipping container particularly suitable for use in the packaging and shipment of articles heretofore conventionally packaged and shipped in less desirable paperboard, kraft board or chip board containers.

The lid component is a domed lid and includes a planar top wall, a continuous outwardly flared perimetrical wall of thin, flexible construction depending peripherally from the top wall and having an endless marginal ledge extending laterally outwardly from the perimetrical wall and carrying a continuous depending skirt adapted to define an interiorly facing, beaded, peripheral channel in which to detachably receive the rim of the tray in snug attached, or snap-fit, relationship. The lid component also characteristically features means for compensating for flexural outward deformation, or bulging, of the perimetrical wall and marginal ledge under stresses resulting from forces impressed, or applied, upon the top wall from such sources as, among others, stacking one or more containers, especially when loaded with articles, one on top of the other during storage or shipment thereof.

In this latter regard, the perimetrical wall of the lid includes a peripherally spaced array of inwardly offset tabs having interiorly facing surfaces aligned in proximately perpendicularly disposed relationship with the top wall and having downwardly extending lower ends providing projecting tongues. The projecting tongues cooperate with the beaded peripheral channel to snugly straddle and strengthen the rim of the tray when the lid is attached thereto. As thus structured, the proximately perpendicular disposition of the tabs imparts substantial strengthening of the perimetrical wall while at the same time affording adequate outward taper, or draft, to accommodate internesting of one lid with another and also to permit easy forming and removal of the lid from a forming mold. Additionally, the lower ends, or projecting tongue portions, of the tabs are arranged to seat snugly within the rim of the tray and restrain the lid against detachment therefrom as a consequence of possible forcible outward flexure of the perimetrical wall resulting from forces exerted upon the top wall of the lid. The tray component is provided with a planar bottom wall peripherally encompassed by a thin, relatively flexible, continuous upstanding wall. The upstanding wall includes a continuous lower wall portion adjoining the bottom wall in normally disposed relationship, and a continuous upper wall portion which flares upwardly and outwardly from the lower wall portion and is provided with a continuous flanged marginal rim over which to attach a lid in snug-fitting, or snap-fit, relationship. The upper wall portion of the tray notably includes a peripherally interspaced array of molded indents which are offset interiorly from the upper wall portion and define interiorly facing surfaces disposed in proximately perpendicular relationship with the bottom wall of the tray. Preferably, the interiorly facing surfaces of the indents together occupy a major region of the upper wall portion and thereby present substantial resistance to flexural outward bowing, or bulging, of the upstanding wall resulting from the application of downward force upon the rim of the tray. The indents while imparting substantial strength to the sidewall of the tray also, like the previously described lid component, afford adequate outward taper, or draft, to facilitate internesting of one tray within another as well as easy vacuum molding and removal of the tray from its forming mold.

To facilitate storage and shipment, the lid and the tray components of the present invention are, as mentioned, each structured in such manner that they are respectively internestable with a plurality of other correspondingly shaped lids and trays. Moreover, this internestability feature facilitates economical return and reuse of the container components after the container has been emptied of its contents.

In a preferred ancillary structural aspect of the present invention, the lid and tray components also include complemental means molded in the top wall of the lid and the bottom wall of the tray for accommodating stacking a plurality of assembled containers in registered vertical alignment one on top of the other.

In accordance with another preferential aspect of the invention, a unitary molded tray and lid having the foregoing structural features are embodied in combination with a plurality of ampuls to form a particulate-free, ampul package especially designed for utilization with conventional production-line, ampul processing and filling apparatus. In more particular respects, the ampul package is structured to contain a plurality of rows of dimensionally corresponding ampuls snugly positioned in the tray component in axially upstanding relationship with a separator sheet of plastic material freely disposed in upstanding position between and separating each row of ampuls. The height of the upstanding wall of the tray is dimensionally correlated with the height, or length, of the ampuls in such manner that the upper ends of the upstanding ampuls project above the rim of the tray and are protectively housed within the domed portion of the attached overlying lid. The upstanding separators within the tray preferably are at least substantially equal in height to the upstanding ampuls and provide an upper edge surface protectively offering underlying resistance against downward forces exerted upon the top wall of the lid.

Accordingly, a basic objective of the present invention is to provide relatively inexpensive lid and tray components suited for assembly into a container and which are respectively characterized by being of a molded unitary design.

Another objective is the provision of a container lid and tray which in addition to possessing the foregoing features are structurally designed in such manner as to be respectively capable of being internested with a plurality of other correspondingly shaped lids and trays.

Another objective is the provision of a domed lid of unitary molded construction which, although having a thin, flexible perimetrical wall, is designed in such manner as to be provided with means in the form of a plurality of peripherally interspaced and inwardly offset tabs molded therein for resisting flexural outward bulging, or bowing, of the perimetrical wall and consequent detachment of the lid from the rim of a tray to which it is attached.

A further objective is the provision of a tray of molded unitary construction which has an upstandng peripheral wall provided with a peripherally interspaced array of interiorly offset indents for strengthening purposes and for defining a plurality of proximately perpendicular interiorly facing surfaces within the tray.

A further objective is the provision of a domed lid and tray which are each of molded unitary construction and are complementally adapted to provide a relatively inexpensive and particulate-free container suitable for the packaging and shipment of ampuls.

A still further objective of the present invention is the provision of a container having the characteristics of the last-mentioned objective and which is designed for snugly packaging rows of ampuls in an axially upstanding position and with each of the rows of ampuls being separated by an upstanding separator sheet disposed therebetween.

A still more particular objective of the present invention is the provision of an ampul package embodying the last-mentioned features and which is especially compatible for unloading, or decasing, the ampuls directly to a conventional ampul processing and filling apparatus of the type described in U.S. Pat. No. 2,896,381.

Other and additional objectives, features and advantages of the present invention will become readily apparent to those ordinarily skilled in the art from the ensuing detailed description taken in conjunction with the annexed fine sheets of drawings whereon a preferred embodiment of the invention is depicted.

DESCRIPTION OF THE PREFERRED EMBODIMENT

Broadly, the present invention embodies the provision of unitary molded container components of thin, lightweight construction which may be inexpensively produced by conventional production-line molding apparatus and at the same time provide a relatively durable and dependable shipping container in which the container components may be quickly and snugly attached or snapped together in detachably interlocked assembly to provide a clean, essentially dust and particulate-free environment for articles packaged within the container. Although other moldable materials may provide the desired structural features and molding characteristics, a particularly desirable material for fabrication of the container components of this invention is high-impact polystyrene which is capable of being economically thermoformed, or vacuum formed, from sheet material into molded lid and tray components having a wall thickness in the range of about 0.010 and 0.030 inch and more desirably in the range of about 0.015 and 0.025 inch.

In a more limited aspect, the container components of the present invention are particularly suited for packaging and shipment of empty, open-ended ampuls and are structured in such manner that they are readily compatible for use with specialized ampul unloading, processing and filling equipment widely used in the pharmaceutical industry. In keeping with this latter aspect, the container components of the present invention, although clearly susceptible for packaging innumerable commodities, are hereinafter described to a substantial extent as preferably structured for utilization for ampul packaging.

Figure 1:
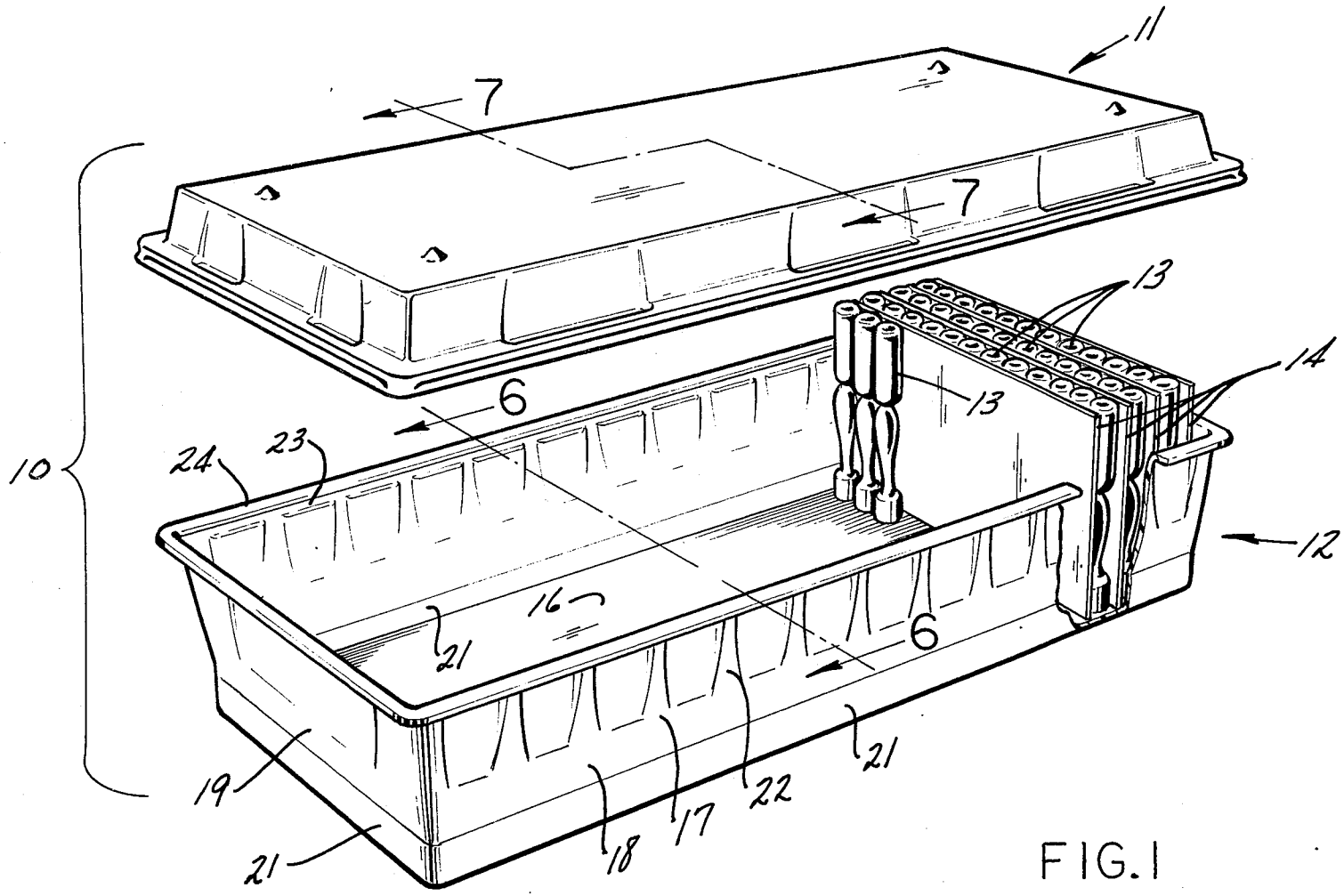
FIG. 1 is an exploded perspective view of a shipping and/or storage container in which the lid and tray components of the present invention are respectively depicted in detached or separated relationship, and with the tray component being characterized in one preferred form of usuage as an ampul storage and/or shipping tray, which for clarity of illustration is portrayed as being only partially loaded with separated rows of empty ampuls and which when fully loaded and having the lid attached provides a clean, particulate-free, durable storage and shipping container for the ampuls while awaiting subsequent processing, medicament filling and hermetic sealing of the ampuls.

Now describing the invention in more particular detail, there is shown in FIG. 1 an ampul package comprising a container 10 with the lid 11 removed and overlying a tray 12 partially filled with snugly packed rows of dimensionally corresponding ampuls 13. As shown, the ampuls are individually arranged in axially upstanding position with the planar freely upstanding separator sheet 14 transversely spanning the tray 12 and separating each transverse row of ampuls 13. For purposes of clarity of description and illustration, the tray 12, which is preferably of generally rectangular configuration, is shown as being only partially loaded with ampuls. It will be understood, however, that when packaging is completed the tray will be completely filled with similarly arranged separated rows of upstanding ampuls and that the lid 11, as illustrated in FIG. 2, will be snugly attached in overlying position on the tray 12.

The tray 12, as previously indicated, is of unitary hollow molded construction and includes a planar bottom wall 16 peripherally encompassed by a thin, relatively flexible, continuous upstanding wall 17 which, in the preferred rectangular configuration shown, includes mutually facing sidewalls 18 and end walls 19 respectively arranged in configurational mirror-image relationship. The upstanding wall 17 also includes a peripherally continuous lower wall portion 21 integrally adjoining the bottom wall 16 along both the sidewalls 18 and end walls 19 in normally, or perpendicularly, disposed relationship throughout its peripheral extent and provides a perpendicular lower sidewall surface against which to snugly retain the lower ends of the ampuls and resist positional shifting, or axial tilting, thereof within the bottom of the tray. Additionally, as will subsequently be discussed in further detail, the perpendicular relationship of the lower wall portion 21 relative to the bottom wall 16 strengthens the upstanding wall by resisting flexural outward bulging thereof.

The upstanding wall 17 of the tray 12, also includes a continuous paper wall portion 22 flaring upwardly and outwardly from the lower wall portion 21 along both the sidewalls 18 and end walls 19 and having a continuous upper marginal rim 23 carrying a laterally outwardly extending continuous flange 24 over which to detachably receive a lid such as the lid 11 in snug, snap-fit relationship.

Figure 2:
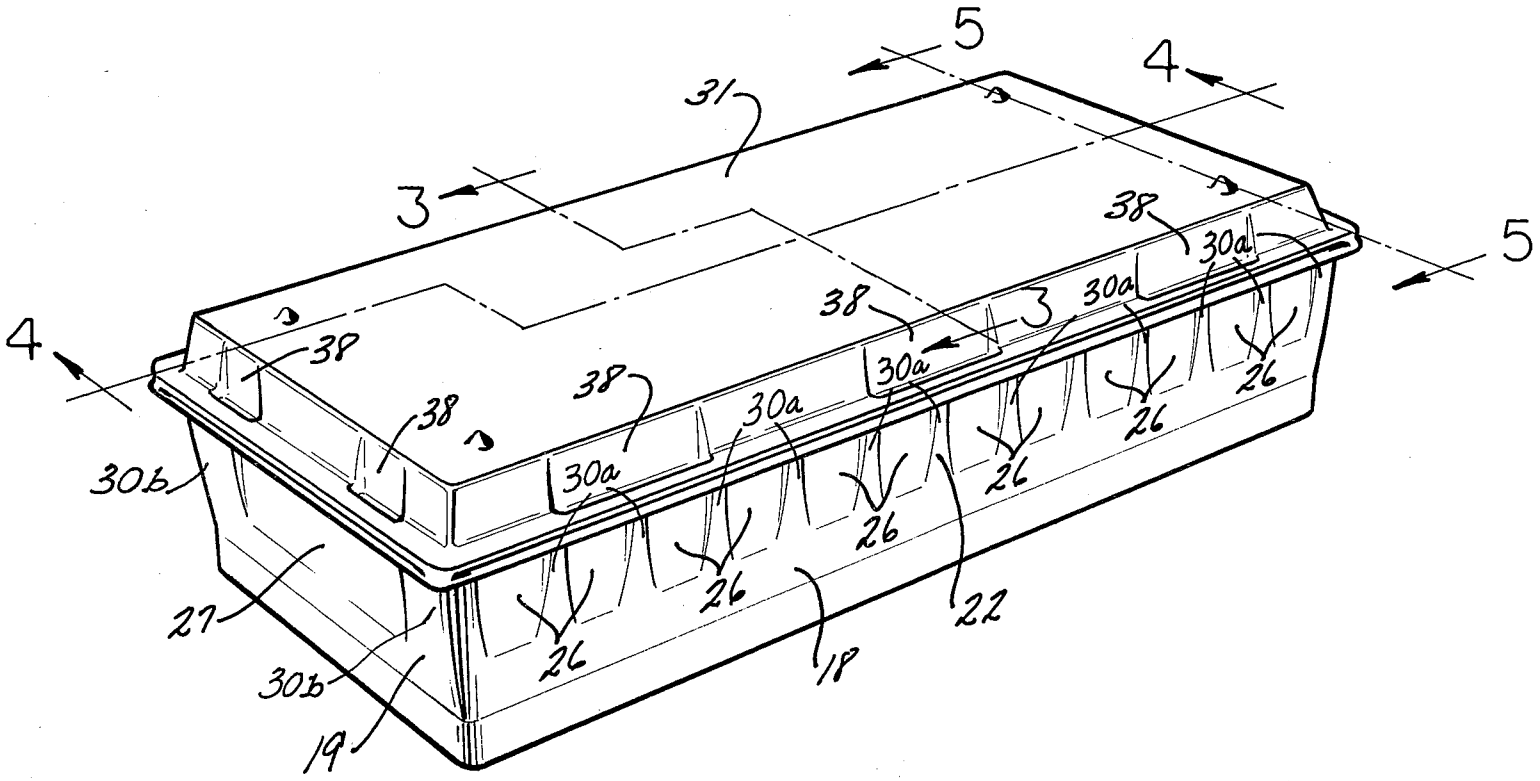
FIG. 2 is another perspective view of the container shown in FIG. 1, but depicting the lid and tray components attached in snap-fit assembled relationship.
Figure 3:
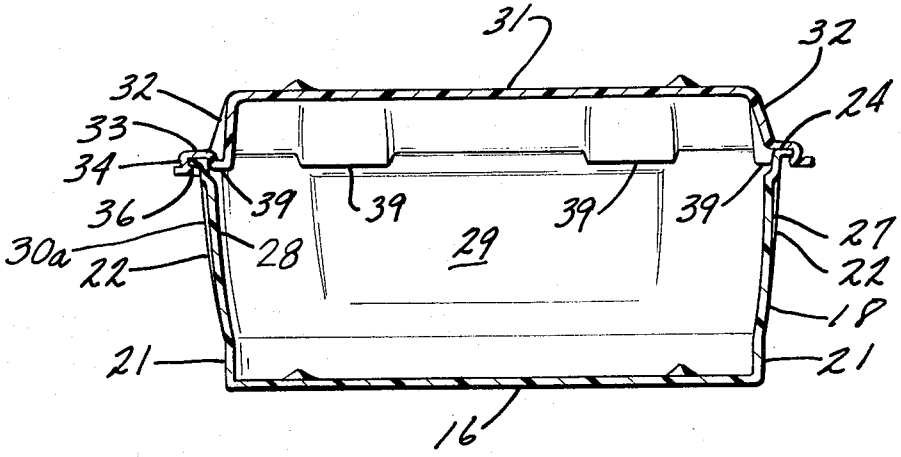
FIGS. 3 and 4 are sectional views taken respectively along and in the directional of sectional planes 3—3 and 4—4 in FIG. 2, with the container contents being omitted for clarity of description and illustration.
Figure 4:
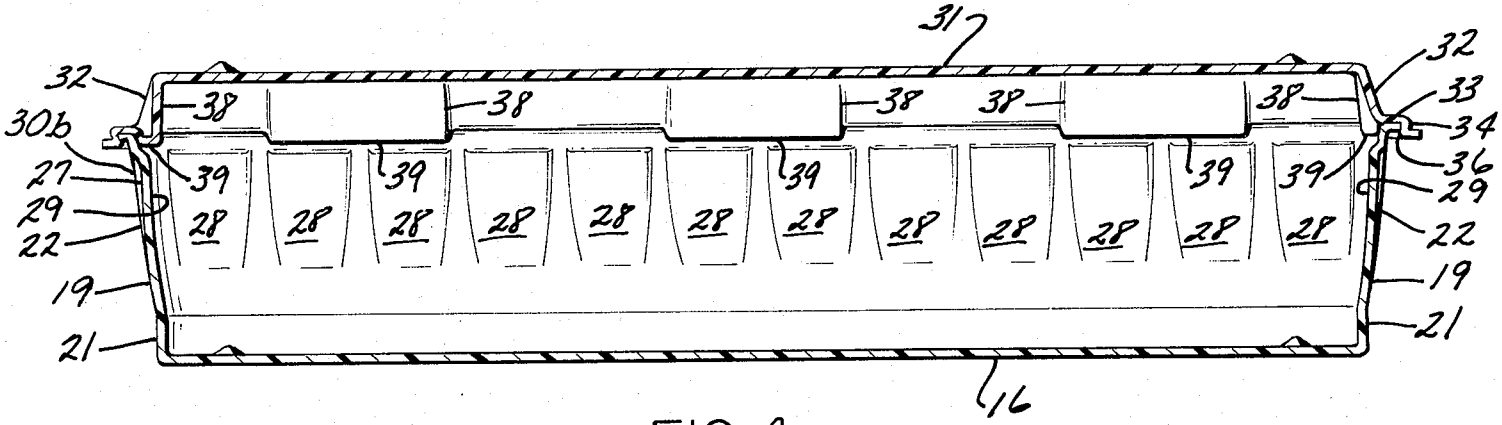

As best shown in FIGS. 2–4, the upstanding wall 17 of the tray also features a peripherally interspaced array of sidewall and end wall indents 26 and 27, respectively, molded in the upper wall portion 22 thereof. Respectively occupying the interspaces between the molded indents 26 and 27, there is a peripherally interspaced array of intermediate rib sections, such as sidewall rib sections 30*a* and endwall rib sections 30*b* diverging outwardly and upwardly relative to the molded indents 26 and 27. As illustrated, the array of molded indents 26 and 27 diverge inwardly and upwardly relative to the outwardly flared upper wall portion and respectively define planar interiorly facing sidewall and end wall surface regions 28 and 29, respectively, which are disposed in proximately perpendicular relationship with the plane of the bottom wall 16 of the tray 12. As used herein, the term "proximately perpendicular" is defined to mean an outward taper or draft deviating outwardly and upwardly from perpendicular by an angle of between about 1° and 4°, and more preferably between about 2° and 3°. This slight outward taper is preferable in order to accommodate internesting of a plurality of correspondingly shaped trays while at the same time obtaining the desirable features of maintaining a substantially perpendicular relationship between the bottom wall 16 and the interiorly facing surfaces of the indents 26 and 27. These desirable features involve, among others, desirable strength and shape factors which will be subsequently described in greater detail.

The domed lid 11 includes a raised planar top wall 31 peripherally surrounded by a continuous outwardly flared perimetrical wall 32 of thin and relatively flexible construction. Extending laterally outwardly from the perimetrical wall 32 there is an endless marginal ledge 33 carrying a continuous depending skirt 34 along its outer peripheral edge. Formed on the depending, or distal, end of the skirt 34 there is an interiorly projecting, substantially continuous, bead 36. As illustrated, the bead 36 underlies the outer reaches of the marginal ledge 33 in adjacently spaced relationship and cooperates with the ledge to define a substantially continuous laterally opening and interiorly facing peripheral channel 37 (best observed in FIG. 7) in which to detachably receive the flange 24 on the rim 23 of the tray 12 in snug, snap-fit relationship. Although the interiorly projecting bead 36 may be of continuous, or endless extent, it is preferred to discontinue the bead in each of the corners of the skirt 34 to facilitate manual corner initiated detachment of the lid 11 and also to accommodate a greater degree of resilient flexing of the bead 36 along the full length of each side of the lid during its attachment on, or detachment from, the tray 12.

Molded in the perimetrical wall 32 of the lid 10 there is a peripherally interspaced array of inwardly offset tabs 38. The tabs 38 respectively define interiorly facing planar surfaces which are aligned in proximately perpendicular relationship with the planar top wall 31 of the lid 11. Additionally, as shown, the tabs 38 have lower ends extending downwardly beyond the inner periphery of the marginal ledge 33 and these lower ends form projecting tongues 39 which are arranged, or disposed, to orient in adjacently spaced juxtaposed relationship with the peripheral channel defined between the interiorly projecting bead 36 and the underside of the marginal ledge 33. As thus arranged, the tongues 39 cooperate with the marginal ledge 33, the bead 36, and the peripheral channel 37 therebetween, to define a peripherally interspaced array of downwardly facing grooves, as at 40 (best observed in FIG. 7), in which to snugly seat the rim 23 of the tray 12 when the lid 11 is attached thereto. Moreover, the projecting tongues 39 restrain the bead 36 from flexing or bulging outward under downward force upon the perimetrical wall and thereby disengaging from the flange 24 on the rim 23 the tray.

In similar manner, as discussed previously with respect to the proximately perpendicular disposition of the planar interiorly facing surface regions 28 and 29 of the molded indents 26 and 27 in the end walls and sidewalls of the tray 12, the term "proximately perpendicular", as it pertains to the interiorly facing planar surfaces of the tabs 38, means a surface taper, or draft, which is disposed at an angle of between about 1° and 4°, and more preferably between about 2° and 3°, from truly perpendicular alignment with the top wall 31 of the lid 11. Additionally, it will be observed that in the rectangular configuration of the lid, as shown, the tabs 38 are essentially identical and a pair of end wall tabs are provided on each end wall of the lid and a plurality (three being shown) of sidewall tabs are provided on each sidewall of the lid; the arrangement of the tabs around the periphery of the lid being such that they are arranged in mirror-image oppositely-facing relationship.

Figure 5:
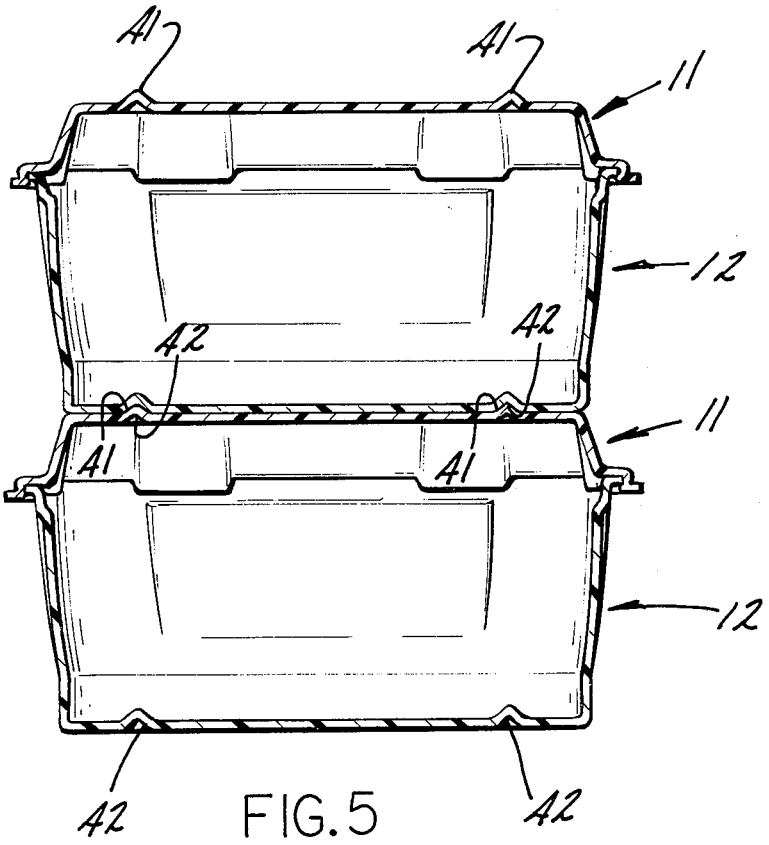
FIG. 5 is a sectional view of a plurality of empty containers (two being shown as representative) stacked in vertically aligned registration one upon another to demonstrate the vertical stacking features embodied in each container, and with the sectional view of each container being taken along and in a direction corresponding to the sectional plane 5—5 of the container shown in FIG. 2.

During storage and shipment of the ampul filled container, it is customary to stack several filled containers one on top of another and to group to stacked containers into a palletized load. To facilitate proper vertical alignment or stacking of one container upon another (as shown in FIG. 5) and to impart upright stability to the stacked containers, means are molded in the lid and tray for accommodating registered vertical alignment of one container on top of another. As illustrated, such registration means are provided in the form of complementally mating, reversely offset surface formations molded in top wall 31 of the lid 11 and the bottom wall 16 of the tray 12. In the form shown, a small upstanding boss 41 is symmetrically located in the proximity of each corner region of the exterior surface of the top wall 31 of the lid 11. Correspondingly, a small notch 42 complementally shaped to conform to each boss 41 is located symmetrically in the proximity of each corner of the exterior surface of the bottom wall 16 of the tray. Thus, as shown in FIG. 5, when the corner bosses 41 are seated in the notches 42 the periphery of the bottom wall of the tray of one container will orientationally register in peripheral alignment with the top wall of the lid of the next succeeding underlying container.

Figure 7:
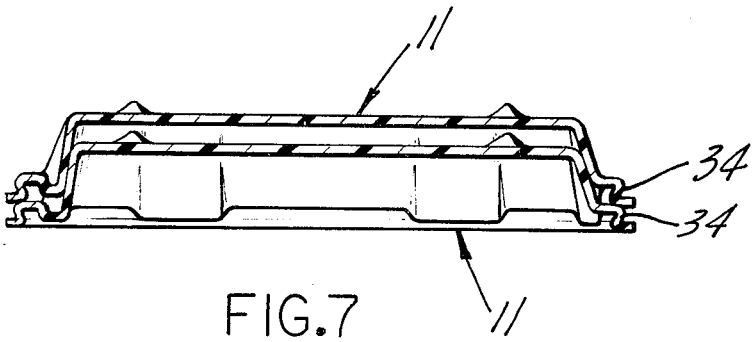
FIG. 7 is a sectional view of an internested stack of lids, such as shown in FIG. 1, with the sectional view of each lid being taken along and in the direction corresponding to the sectional plane 7—7 of the lid component shown in FIG. 1.
Figure 6:
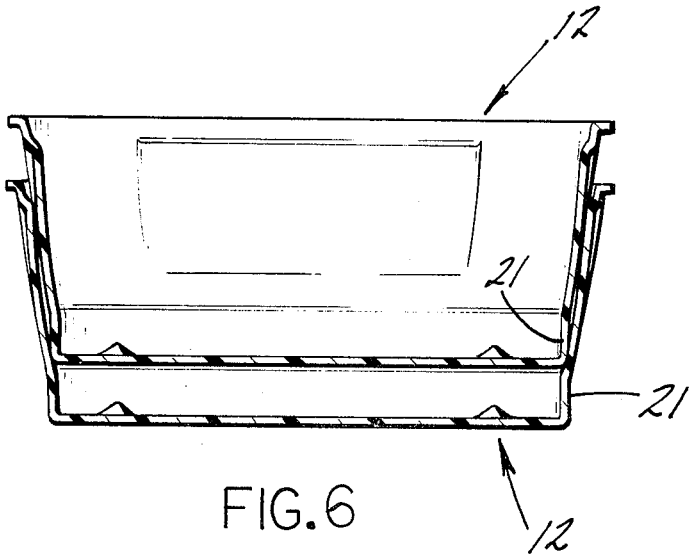
FIG. 6 is a central sectional elevational view of an internested stack of trays such as shown in FIG. 1, with the sectional view of each tray being taken along and in the direction corresponding to the sectional plane 6—6 of the tray component shown in FIG. 1.

The internestability features of the tray and lid components are shown respectively in FIGS. 6 and 7. In FIG. 6, the internestable stackability of a plurality of the tray components of the present invention is indicated by a pair of internested trays 12. As internested, the perpendicular alignment of lower wall portion 21 relative to the bottom wall 16 of each tray serves to provide a peripheral seat upon which to support the bottom wall of another tray nested therewithin in slightly elevated position. As thus loosely internested, the trays can be readily stacked one within the other while avoiding undesirable wedging or jamming together of the trays. When internested, as in FIG. 7, the lids 11 stack neatly one within the other and are prevented from wedging or fitting too tightly together by the depending skirt 34 which seats upon the marginal ledge 33 of the next underlying lid and serves as a support for preventing the lids from jamming tightly together.

When utilized as an ampul package, as depicted in FIG. 1, it is also preferable that the planar separator sheet 14, as well as the lid and tray components 11 and 12, respectively, be fabricated from a plastic material such as high-impact polystyrene, or a like plastic material, which is capable of being formed as a semi-rigid, smooth-surfaced sheet and which, unlike paperboard materials, will not constitute a source for the generation of fine particulates or dust within the package. In accordance with the operational characteristics of the ampul decasing, or unloading, apparatus conventionally employed with the widely-used, production-line, ampul processing and filling equipment commonly utilized by pharmaceutical suppliers, and described in the aforementioned U.S. Pat. No. 2,896,381, the thickness of the separator sheets preferably should have a uniform transverse thickness in the range of between about 0.033 and 0.035 inch. For other types of ampul processing equipment such dimensional limitations of the separator sheets may, of course, be altered to meet the operational requirements of the equipment being used.

During storage and shipment of the assembled and loaded containers, or ampul packages, they are ordinarily stacked one upon another, as previously described with reference to FIG. 5. Such stacking, of course, requires that the container components, despite their lightweight and relatively flexible construction, possess sufficient sidewall flexural strength characteristics to withstand the bearing loads encountered during stacking and shipment. To this end, the peripherally interspaced array of molded indents 26 are closely interspaced and together provide, or occupy, a major portion of the length and surface area of the upper wall portion 22 of each of the sidewalls 18 of the tray. Likewise the molded indents 27 occupy a major portion of the length and surface area of the upper wall portion 22 of each of the end walls of the tray. Thus, by virtue of the proximately perpendicular orientation of the molded indents 26 and 27 in the upper wall portion 22 of the tray, coupled with the perpendicular disposition of the lower wall portion 21 of the tray, substantial resistance to lateral bulging, or deformation, is structured into the sidewalls and end walls of the tray 12. Moreover, additional resistance to lateral bulging, or deformation, is provided by the proximately perpendicular, offset tabs 38 molded in the lid 11 which similarly strengthen the perimetrical wall 32 of the lid and also, by means of the tongues 39, substantially stiffen the rim 23 of the tray 12 when the lid is attached thereon.

In view of the foregoing, it is manifest that the unitary molded container components of the present invention can be readily and inexpensively fabricated to provide a particulate-free container or ampul package which obviates the dust and cleanliness problems heretofore experienced with cardboard, chip board and like paper board shipping containers. Moreover, the container components are structured in such manner as to be adapted to package empty, open-ended ampuls in upstanding position with the ampuls aligned in rows separated by separator sheets. As thus packaged the ampuls can be readily unloaded, or decased, by a pharmaceutical supplier using conventional ampul processing apparatus.

By way of additional features, the lid and tray components are designed so that they can be internested for convenient and economical storage or shipment. Also, when assembled together as a container the lid and tray embody registration means for assuring vertically aligned stacking of one container upon another.

It will, of course, be understood that various details of construction, combination and assembly may be modified throughout a wide range of equivalents, and it is, therefore, not the purpose to limit the scope of the present invention otherwise than as necessitated by the scope of the appended claims.

We claim:

1. A container package comprising:

(A) a unitary molded hollow tray having a generally planar bottom wall peripherally encompassed by a thin relatively flexible continuous upstanding wall flaring upwardly and outwardly relative to said bottom wall, said upstanding wall having a continuous lower wall portion adjoining said bottom wall in essentially normally disposed relationship and including:

(i) a continuous upper wall portion having a continuous rim, (ii) a peripherally interspaced array of indents molded therein, said indents being offset interiorly from said upper wall portion and respectively defining an interiorly facing surface region disposed in proximately perpendicular relationship with said bottom wall and providing resistance to lateral deformation of said upstanding wall, (iii) a peripherally interspaced array of intermediate rib sections respectively occupying the interspaces between said indents and diverging outwardly and upwardly relative thereto;

(B) a plurality of rows of dimensionally corresponding containers gravitationally resting in axially upstanding and snug side-by-side relationship within said tray and having axial end portions projecting above the rim of said tray;

(C) a separator sheet of plastic material freely disposed in snug upstanding position between and separating each of said rows of containers; and (D) a domed lid of unitary molded construction snugly attached over the rim of said tray and enclosing the axial end portions of said containers projecting above the rim of said tray, said lid including;

(i) a planar top wall, (ii) a continuous outwardly flared perimetrical wall of thin, flexible construction depending peripherally from said top wall, (iii) an endless marginal ledge extending laterally outwardly from said perimetrical wall and peripherally carrying a continuous depending skirt detachably attached over the rim of said tray in snug snap-fit relationship, and (iv) a peripherally interspaced array of inwardly offset tabs respectively defining interiorly facing surfaces aligned in proximately perpendicular relationship with said top wall and having a lower end extending downwardly beyond the inner periphery of said ledge and forming a projecting tongue disposed in adjacently spaced juxtaposed relationship with said peripheral skirt to provide said snap-fit relationship.

2. A container package as defined in claim 1, wherein said indents respectively diverge and rise interiorly from said upstanding wall and terminate in an interiorly disposed series of horizontally aligned lateral ledges at a location proximately below and longitudinally paralleling said rim.

3. A container package as defined in claim 1, wherein said bottom wall of said tray and said upstanding wall generally define a rectangular peripheral configuration, and wherein said upstanding wall includes a pair of mutually opposite end walls and a pair of mutually opposite sidewalls.

4. A container package as defined in claim 3, wherein at least one each of said array of indents is molded in each of said end walls and sidewalls.

5. A container package as defined in claim 4, wherein a plurality of said indents are formed on each of said sidewalls.

6. A container package as defined in claim 5, wherein said indents on said sidewalls occupy a major portion of the length of said sidewalls.

7. A container package as defined in claim 6, wherein said tray is a plastic tray.

8. A container package as defined in claim 7, wherein said tray is thermoformed high impact polystyrene.

9. A container package as defined in claim 8, wherein said bottom wall and said upstanding wall respectively have wall thicknesses of between about 0.010 and 0.030 inch.

10. A container package as defined in claim 9, wherein said bottom wall and said upstanding wall respectively have wall thicknesses of between about 0.015 and 0.025 inch.

11. A container package as defined in claim 1, wherein said lid top wall defines a generally rectangular peripheral configuration, and wherein said perimetrical wall includes a pair of mutually opposite end walls and a pair of mutually opposite sidewalls.

12. A container package as defined in claim 1, wherein said lid is molded plastic.

13. A container package as defined in claim 12, wherein said bottom wall, said perimetrical wall and said marginal ledge respectively of said lid have wall thicknesses of between about 0.010 and 0.030 inch.

14. A container package as defined in claim 13, wherein said lid is thermoformed polystyrene.

15. A container package as defined in claim 14, wherein said bottom wall, said perimetrical wall and said marginal ledge respectively of said lid have wall thicknesses of between about 0.015 and 0.025 inch.

16. A container package as defined in claim 1, wherein said tray and said lid respectively define a generally rectangular peripheral configuration, and wherein said rows of container are arranged in substantially parallel rows transversely spanning said tray and said lid.

17. A container package as defined in claim 1, wherein said separator sheet is a semi-rigid, smooth-faced planar sheet of substantially uniform thickness.

18. A container package as defined in claim 17, wherein said separator sheet defines a substantially rectangular configuration and is disposed with one edge gravitationally resting on the bottom wall of said tray and with an opposite edge disposed in substantially planar alignment with the projecting end portions of said container.

19. A container package as defined in claim 18, wherein said separator sheet has a uniform thickness of about 0.033 to about 0.035 inch.

20. A container package as defined in claim 19, wherein said separator sheet is formed from high impact polystyrene.

21. A container package as defined in claim 18, wherein said containers are in the form of ampuls.

22. A container comprising:

(A) a unitary molded hollow tray having a generally planar bottom wall peripherally encompassed by a thin relatively flexible continuous upstanding wall, said upstanding wall including;

(i) a continuous lower wall portion adjoining said bottom wall in essentially normally disposed relationship, and (ii) a continuous upper wall portion flaring upwardly and outwardly from said lower wall portion and having a continuous marginal rim carrying a laterally outwardly extending continuous flange, said upper wall portion having (a) a peripherally interspaced array of indents molded therein, said indents being offset interiorly from said upper wall portion and respectively defining a generally planar interiorly facing surface region overlying said lower wall portion and disposed in proximately perpendicular relationship with said bottom wall, and (b) a peripherally interspaced array of intermediate rib sections respectively occupying the interspaces between said indents and diverging outwardly and upwardly relative thereto; and (B) a domed lid of unitary molded construction snugly attached on the rim of said tray, said lid including;

(i) a planar top wall, (ii) a continuous outwardly flared perimetrical wall of thin, flexible construction depending peripherally from said top wall, (iii) an endless marginal ledge extending laterally outwardly from said perimetrical wall and peripherally carrying a continuous depending skirt provided with a substantially continuous interiorly projecting bead underlying the outer reaches of said ledge in adjacently spaced relationship to define a substantially continuous laterally opening and interiorly facing peripheral channel detachably receiving the rim of said container in snugly attached relationship; and (iv) a peripherally interspaced array of inwardly offset tabs respectively defining interiorly facing surfaces aligned in proximately perpendicular relationship with said top wall and having a lower end extending downwardly beyond the inner periphery of said ledge and forming a projecting tongue disposed in adjacently spaced juxtaposed relationship with said peripheral channel to define therebetween a downwardly facing groove snugly confining said rim of said tray therein and cooperating with said channel to yieldably resist detachment of said lid from said tray.

23. A container as defined in claim 22, wherein at least one each of said plurality of tabs is provided in each of said end walls and sidewalls.

24. A container as defined in claim 22, including means for accommodating stacking of said container with another like container in registered vertical alignment one on top of the other, said means comprising mating reversely offset surface formations molded in the top and bottom walls respectively of said tray and said lid.

25. A container as defined in claim 22, wherein said tray and said lid respectively define a generally rectangular configuration with each including a pair of mutually opposite end walls and a pair of mutually opposite sidewalls, and wherein at least one indent is provided on each endwall and each sidewall of said tray and at least one tab is provided on each endwall and each sidewall of said lid.

26. A container as defined in claim 25, wherein all of the walls of said tray and said lid are between about 0.010 and 0.030 inch thickness.

27. A container as defined in claim 26, wherein said tray and said lid are respectively thermoformed polystyrene.

28. A container as defined in claim 27, wherein all of the walls of said tray and said lid are between about 0.015 and 0.025 inch thickness.

29. An ampul package comprising, in combination:

(A) a unitary hollow plastic tray including (i) a generally planar bottom wall, (ii) a thin relatively flexible upstanding wall peripherally encompassing said bottom wall and having an upper portion thereof flaring upwardly and outwardly from said bottom wall and terminating in a continuous marginal rim carrying a laterally outwardly extending marginal flange;

(B) a plurality of rows of dimensionally corresponding ampuls gravitationally resting in axially upstanding and snug side-by-side relationship within said tray and having axial end portions projecting above said tray;

(C) a separator sheet of plastic material freely disposed in snug upstanding position between and separating each of said rows of ampuls;

(D) a unitary plastic domed lid snugly and detachably attached on the rim of said tray and enclosing the axial end portions of said ampuls projecting above said tray, said lid including (i) a planar top wall, (ii) a continuous perimetrical wall depending peripherally from said top wall, (iii) an endless marginal ledge extending laterally outwardly from said perimetrical wall and peripherally carrying a continuous depending skirt provided with a substantially continuous interiorly projecting bead adjacently underlying the outer reaches of said ledge and cooperating therewith to define a substantially continuous laterally opening and interiorly facing peripheral channel detachably receiving the rim of said container in snugly attached relationship, said perimetrical wall having sufficient flexibility to undergo outward flexure under stresses resulting from forces impressed exteriorly against said top wall and thereby cause said ledge to correspondingly flex said bead outward from its normal position for snug attachment on the rim of said tray, (iv) a peripherally interspaced array of flared wall sections flaring downwardly and outwardly from said perimetrical wall, and a peripherally interspaced array of inwardly offset tabs respectively interspacing said flared wall sections, said tabs respectively defining an interiorly facing surface aligned in proximately perpendicular relationship with said top wall and having a lower end extending downwardly beyond said ledge and forming a projecting tongue disposed in adjacently spaced juxtaposed relationship with said peripheral channel to define therebetween a downwardly facing groove snugly confining said rim of said tray therein and restraining said bead against detachment from said rim as a consequence of outward flexure of said perimetrical wall.

30. A container package comprising, in combination (A) a unitary molded hollow plastic tray including (i) a generally planar bottom wall, (ii) a thin, relatively flexible upstanding wall peripherally encompassing said bottom wall and generally flaring upwardly and outwardly from said bottom wall and terminating in a marginal rim, (iii) peripherally interspaced indents molded in said upstanding wall and diverging inwardly and upwardly therefrom to define an interiorly facing surface region disposed in proximately perpendicular relationship with said bottom wall;

(B) a plurality of rows of dimensionally corresponding containers in axially upstanding and snug side-by-side relationship within said tray and having axial end portions projecting above the rim of said tray;

(C) a separator sheet of plastic material freely disposed in snug upstanding position between and separating each of said rows of containers; and (D) a domed lid of unitary molded construction detachably attached snugly on the rim of said tray and enclosing said containers, said lid including:

(i) a planar top wall, (ii) a downwardly projecting outwardly flared perimetrical wall depending peripherally from said top wall and having an outwardly flared portion and constructed of thin, flexible material, (iii) an endless marginal ledge extending laterally outwardly from said outwardly flared portion of said wall and peripherally carrying a continuous depending skirt provided with an interiorly projecting bead underlying the outer portion of said ledge in adjacently spaced relationship to define a laterally opening and interiorly facing peripheral channel detachably receiving the rim of said tray in an attaching relationship; and (iv) a peripherally interspaced array of inwardly offset tabs respectively defining interiorly facing surfaces aligned in proximately perpendicular relationship with said top wall and having a lower end extending downwardly beyond the inner periphery of said ledge and forming a projecting tongue disposed in adjacently spaced juxtaposed relationship with said peripheral channel to define therebetween a downwardly facing groove snugly confining said rim of said tray therein and cooperating with said channel to yieldably resist detachment of said lid from said tray.

31. A container package as defined in claim 30, wherein said indents are molded in mutually facing wall portions of said upstanding wall.

32. A container package as defined in claim 31, wherein said tray defines a generally rectangular configuration with said upstanding wall including mutually facing endwalls and mutually facing sidewalls, and wherein at least one of said indents is molded in each of said endwalls.

33. A container package as defined in claim 31, wherein said tray defines a generally rectangular configuration with said upstanding wall including mutually facing endwalls and mutually facing sidewalls, and wherein at least one of said indents is molded in each of said sidewalls.

34. A container package as defined in claim 33, wherein at least one of said indents is molded in each of said endwalls.

35. A container package as defined in claim 33, including means for accommodating stacking of said package with another like package in registered vertical alignment one on top of the other, said means comprising mating reversely offset surface formations molded in the top and bottom walls respectively of said tray and said lid.

* * * * *

UNITED STATES PATENT AND TRADEMARK OFFICE

CERTIFICATE OF CORRECTION

PATENT NO. : 4,235,338

DATED : November 25, 1980

INVENTOR(S) : D. R. Dugan and K. E. Prince

It is certified that error appears in the above-identified patent and that said Letters Patent are hereby corrected as shown below:

Col. 3, line 21, "The tray" should begin a new paragraph.

Col. 4, line 63, "fine" should be --five--.

Col. 6, line 43, "paper" should be --upper--.

Col. 11, line 11 (Claim 11) after "said" insert "lid".

Signed and Sealed this

*Ninth* Day of *June 1981*

[SEAL]

*Attest:*

RENE D. TEGTMEYER

*Attesting Officer*

*Acting Commissioner of Patents and Trademarks*